US006401273B1

(12) United States Patent
Fung et al.

(10) Patent No.: US 6,401,273 B1
(45) Date of Patent: Jun. 11, 2002

(54) ADJUSTABLE PORTABLE BATH TUB SPA

(75) Inventors: Kam Fai Fung, Tuen Mun; Anthony Kit Lun Leung, Northpoint, both of (HK); Richard Neil Tobin, Stamford; Barry Victor Prehodka, Ridgefield, both of CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 09/671,373

(22) Filed: Sep. 27, 2000

(51) Int. Cl.[7] ..... A61H 33/02
(52) U.S. Cl. ..... 4/559; 4/541.4
(58) Field of Search ..... 4/541.1, 541.3, 4/541.4, 559; 601/167

(56) References Cited

U.S. PATENT DOCUMENTS

| | | | | | |
|---|---|---|---|---|---|
| 3,034,139 | A | * | 5/1962 | Kapnick et al. | 4/541.3 |
| 3,846,848 | A | | 11/1974 | McNair | 4/559 X |
| 3,861,384 | A | | 1/1975 | Casternovia | 4/559 X |
| 3,961,382 | A | | 6/1976 | Peterson, Jr. | 4/541.4 |
| 4,100,917 | A | * | 7/1978 | Talge et al. | 4/541.4 X |
| 4,127,117 | A | | 11/1978 | Peterson, Jr. | 4/541.4 X |
| 4,282,866 | A | | 8/1981 | Miffitt | 4/541.3 X |
| 4,630,599 | A | | 12/1986 | Perovick et al. | 4/541.3 |
| 4,726,917 | A | | 2/1988 | Abe | 4/541.4 X |
| 4,774,934 | A | | 10/1988 | Hara | 601/157 |
| 4,872,224 | A | | 10/1989 | Grimes | 4/541.3 |
| 4,957,101 | A | | 9/1990 | Hara | 4/541.3 |
| 5,031,255 | A | * | 7/1991 | Hilger et al. | 4/541.4 |
| 5,173,973 | A | | 12/1992 | Mersmann | 4/541.1 |
| 5,386,598 | A | | 2/1995 | Mersmann | 4/541.4 |
| 5,822,808 | A | * | 10/1998 | Esser | 4/559 X |

* cited by examiner

*Primary Examiner*—Robert M. Fetsuga
(74) *Attorney, Agent, or Firm*—Ohlandt, Greeley, Ruggiero & Perle, LLP

(57) ABSTRACT

A bath tub spa is provided that has a motor housing with a motor for driving a pump. The pump has an input opening and an output opening sealed about the pump such fluid is drawn through said input opening and expelled through the output opening. The spa also has a nozzle removably sealed to said output opening, and a connector for connecting the motor housing to the bath tub such that the input opening is maintained at least partially below a level of fluid and at least a portion of the nozzle is maintained below the level of the fluid. The motor housing is rotatable about a first axis, the output opening is rotatable about a second axis, and the nozzle is rotatable about a third axis.

35 Claims, 7 Drawing Sheets

ADJUSTABLE PORTABLE BATH TUB SPA

BACKGROUND OF THE INVENTION

1. Field of the Invention

The present invention relates to a bath tub spa. More particularly, the present invention relates to a portable bath tub spa for residential bath tubs. The present invention further relates to a bath tub spa having output nozzles that are adjustable.

2. Description of the Prior Art

Apparatus are known that provide current and/or bubbles to the water within a residential bath tub. For example, U.S. Pat. No. 3,961,382 provides a portable whirlpool or hydrotherapy bath assembly of the type that mounts on the upper edge of the wall of a bath tub. The apparatus of this patent has a single pump, which draws water from an inlet and passes the water through an outlet that is unitary with the pump housing. The outlet is rotatable about one axis to change the direction of water flowing from the outlet.

U.S. Pat. No. 4,726,917 provides a water current and air bubble generating apparatus that sits on the bottom of the tub. The apparatus of this patent has a single pump, which draws water from an inlet and passes the water through a pair of outlets. The outlets are rotatable about two axes to change the direction of water flowing from the outlet and are vertically adjustable. The apparatus of this patent, resting on the bottom of the tub, has its electrical components completely submerged within the water.

Prior art bath tub spas, such as the ones described above, do not provide for multiple water inlets or outlets driven by a single motor. Additionally, prior art spas do not provide for dual shaft motors driving impellers to urge the water from a pair of outlets. Moreover, the prior art spas do not provide means to adequately adjust the position of the water outlets from a spa mounted on the lip of the tub.

SUMMARY OF THE INVENTION

It is an object of the present invention to provide a portable bath tub spa.

It is another object of the present invention to provide such a tub spa having a double shaft motor.

It is a further object of the present invention to provide such a tub spa having pump outputs that are rotatable about more than two axes.

It is a further object of the present invention to provide such a tub spa having pump outputs independently adjustable about a first axis and nozzles independently adjustable about a second axis wherein the nozzles are collectively adjustable vertically with respect to the water surface via connection and are collectively rotatable about a third axis.

It is yet a further object of the present invention to provide such a tub spa having a housing that is vertically adjustable to adjust the height of pump outputs to correspond with the amount of water in the bath tub.

These and other objects of the present invention are provided by a bath tub spa having a motor housing that includes a motor for rotatably driving a pair of shafts with each shaft driving a pump, an input opening and an output opening sealed about each pump such that each pump draws fluid through the input opening and expels pressurized fluid through the output opening. The spa also has means for removably connecting the motor housing to the lip of a bath tub such that the input openings of the spa are maintained at least partially below the level of the fluid in the tub. Preferably, at least a portion of the output openings of the spa are maintained below the level of the fluid.

DETAILED DESCRIPTION OF THE INVENTION

Figure 1:
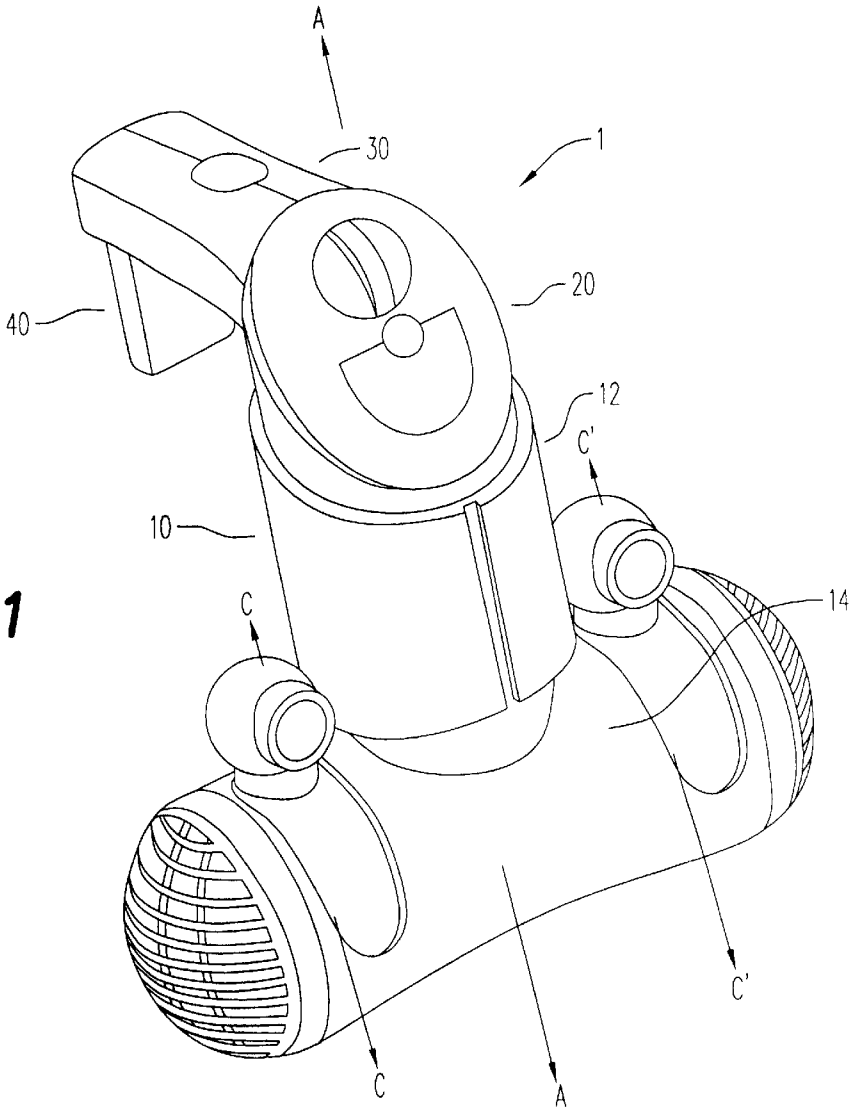
FIG. 1 is a front left perspective view of the bath tub spa of the present invention.
Figure 2:
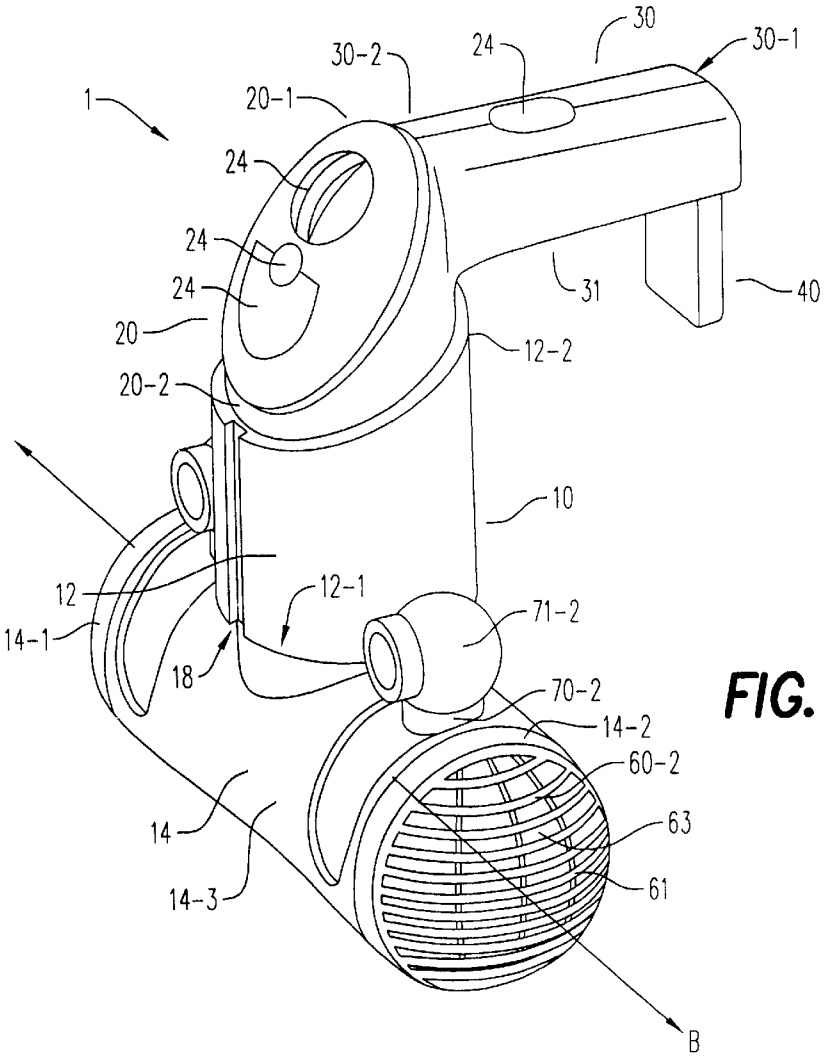
FIG. 2 is a right side perspective view of the bath tub spa of FIG. 1.
Figure 3:
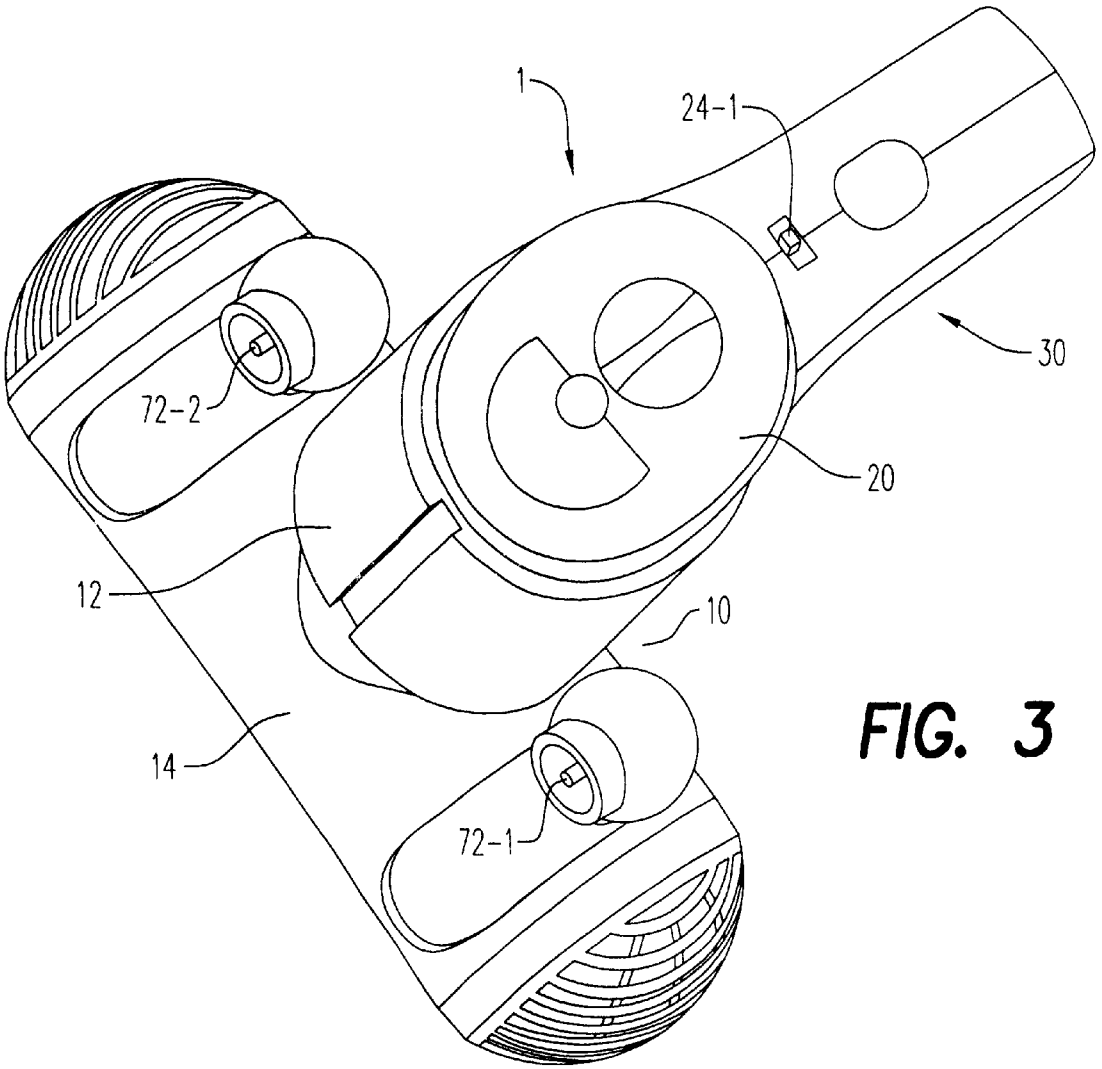
FIG. 3 is a top view of the bath tub spa of FIG. 1.

Referring to the figures and, in particular, FIGS. 1 through 3, there is provided a spa generally represented by the reference numeral 1. Spa 1 has a motor housing 10, a control housing 20, a support arm 30 and a down turning extension 40. In an alternate embodiment shown in FIG. 4*b*, support arm 30 does not include down turning extension 40.

Referring to FIG. 2, support arm 30 has a bottom side 31, a first end 30-1 and a second end 30-2. Spa 1 is designed such that bottom side 31 rest on the upper lip of a bath tub (not shown). In one embodiment shown in FIG. 4*b*, at least one suction cup 90 is provided on bottom side 31 of support arm 30 to removably secure (i.e., connect) spa 1 to the bath tub. In yet another embodiment shown in FIG. 4*a*, support arm 30 includes down turning extension 40 removably securing (i.e., connecting)spa 1 to the bath tub. In still other alternate embodiments, extension 40 and suction cups 90 are used separately and in conjunction with one another as means for removably connecting (i.e., securing) spa 1, including motor housing 10, to bath tub 100.

Support arm 30 has a first end 30-1 and a second end 30-2. With spa 1 resting on and removably secured to the lip of the tub as described above, first end 30-1 projects away from the tub and second end 30-2 projects towards the bath tub.

Control housing 20 has a first end 20-1, a second end 20-2 and a plurality of control switches 24. First end 20-1 of control housing 20 is connected to second end 30-2 of support arm 30 at an angle such that the control housing projects into the tub. In an preferred embodiment, control housing 20 is connected to second end 30-2 of support arm 30 at about ninety two degrees. Control switches 24 are provided to control spa 1 and include, for example, push buttons switches and rotary switches. In an alternate embodiment, at least some of control switches 24 are provided on support arm 30.

Motor housing 10 has a main leg 12, a secondary leg 14 and a slidable connection 18. Main leg 12 has a first end 12-1 and a second end 12-2. Secondary leg 14 has a first end 14-1, a second end 14-2, a center 14-3 and a cavity 15 is defined therein. Second end 12-2 of main leg 12 is connected to second leg 20-2 of control housing 20. First end 12-1 of main leg 12 is slidably and rotatably connected to secondary leg 14 at its center 14-3 via connection 18. Thus, main leg 12 and secondary leg provide motor housing 10 with a preferably T-shaped appearance. More preferably, motor housing 10 is cylindrical.

Connection 18 enables secondary leg 14 to slide with respect to primary leg 12 into and out of the liquid in the bath tub without engaging the bottom of the tub. In one embodiment, secondary leg 14 is slidable about two inches with respect to main leg 12.

Figure 4B:
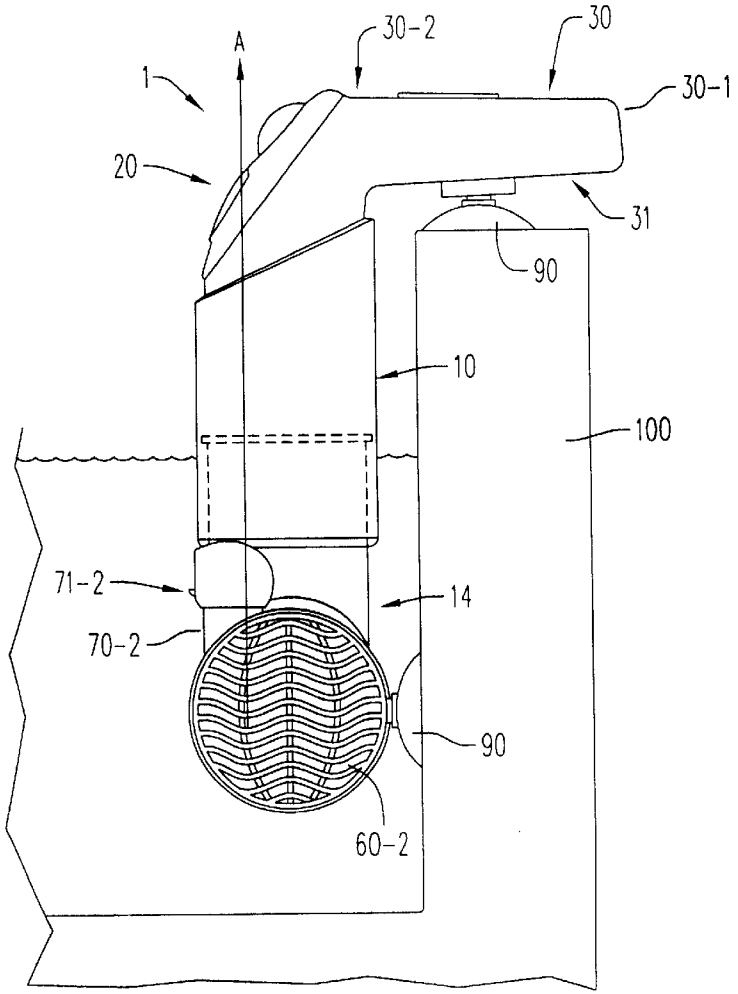
FIG. 4*b* is a side view of the bath tub spa of FIG. 1 showing the motor housing in a retracted position.
Figure 4A:
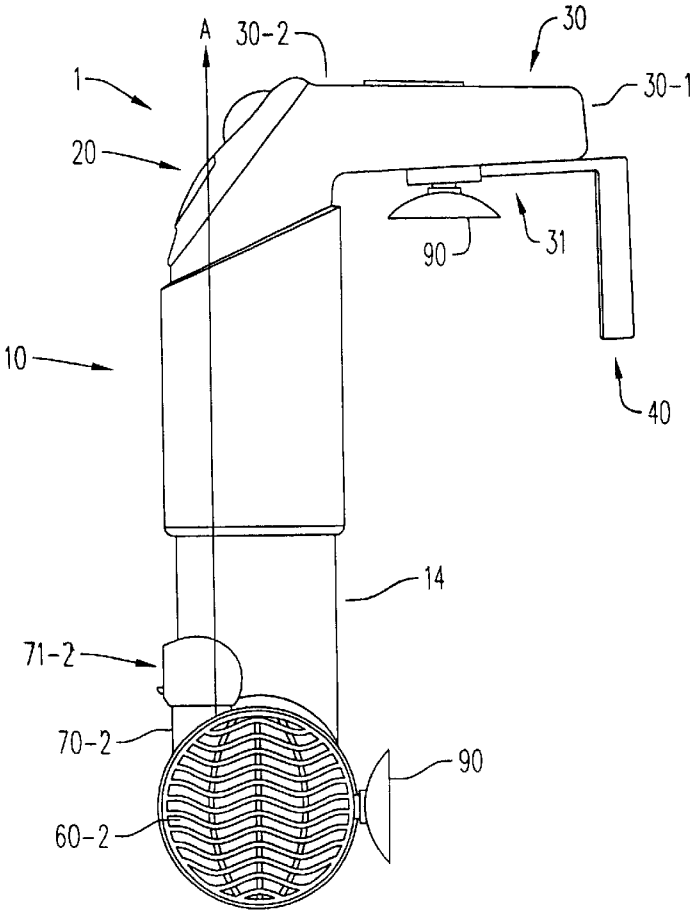
FIG. 4*a* is a side view of the bath tub spa of FIG. 1 showing the motor housing in an extended position and having a downward extension.

Moreover, connection 18 enables secondary leg 14 to rotate with respect to primary leg 12 about a first axis, shown as axis A in FIGS. 1, 4*a* and 4*b*, up to about ninety degrees. During operation of spa 1, secondary leg 14 is adjusted with respect to main leg 12 such that at least a portion of the nozzles 71-1, 71-2, described below, and such that at least a portion of the pump inputs 60-1, 60-2, described below, remain submerged in the liquid in the tub. Rotation of secondary leg 14 about ninety degrees with respect to primary leg 12 provides the additional benefit of providing spa 1 with a smaller profile for packaging, thus reducing packaging and shipping expenses. In a preferred embodiment, connection 18 is a ball and detent connection wherein the detents act to counteract forces acting on the connection such as the weight of secondary leg 14 and the thrust forces of the water expelled from nozzles 71.

In an alternate embodiment, shown in FIG. 3, spa 1 generates bubbles within the liquid driven or expelled through nozzles 71-1, 71-2. In this embodiment, control switches 24 include a bubble button 24-1 and nozzles 71-1, 71-2 include a bubble tubes 72-1, 72-2, respectively. Bubble tubes 72-1, 72-2 are in fluid communication with one another and with bubble button 24-1. Bubble button 24-1 has at least an open position and a closed position. In the open position, bubble button 24-1 places bubble tubes 72-1, 72-2 in fluid communication with ambient air. In the closed position, bubble button 24-1 seals bubble tubes 72-1, 72-2 from ambient air. In alternate embodiments, bubble button 24-1 has a plurality of partially open positions, which place bubble tubes 72-1, 72-2 in a plurality of degrees of fluid communication with ambient air. Liquid forced through nozzles 71-1, 71-2 by pump impeller 52-1, 52-2, respectively, will pull air through bubble tubes 72-1, 72-2 from ambient air when bubble button 24-1 is at least partially open to generate bubbles.

In an alternate embodiment shown in FIGS. 4*a* and 4*b*, secondary leg 14 further includes one suction cup 90 provided on first end 14-1 and one suction cup 90 provided on second end 14-2. Suction cups 90 on leg 14 are provided to removably securing spa 1 to the bath tub. In alternate embodiments, extension 40 and suction cups 90 of support arm 30 and suction cups 90 of secondary leg 14 are used separately and in conjunction with one another.

Figure 5:
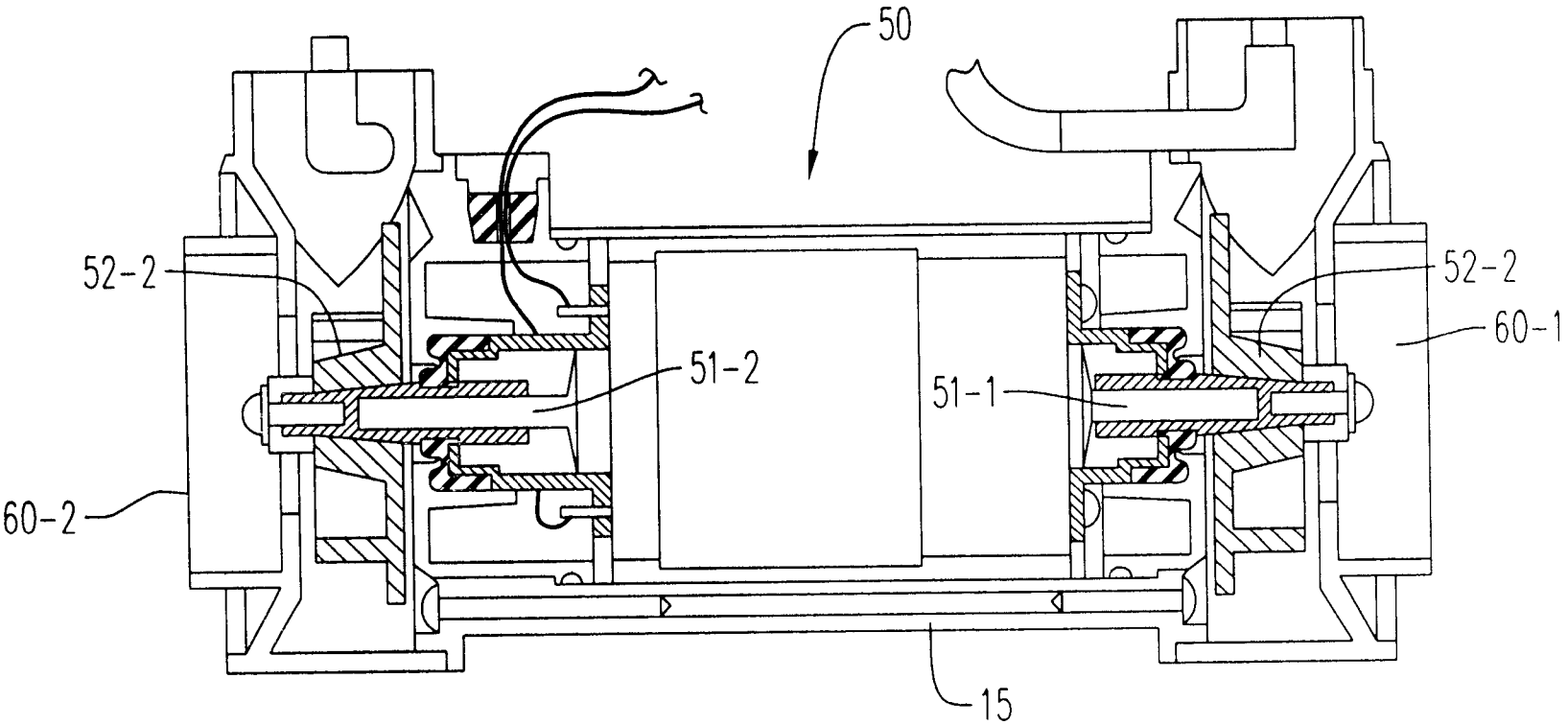
FIG. 5 is a cut away view of the motor housing of the bath tub spa of FIG. 1.

Referring to FIG. 5, cavity 15 is adapted to receive a motor 50. Motor 50 is adapted to drive two shafts 51-1 and 51-2. Each shaft 51-1, 51-2 is adapted to drive a pump impeller 52-1, 52-2, respectively. Each pump impeller 52-1, 52-2 has a pump input 60-1, 60-2 and a pump output 70-1, 70-2, respectively. In an alternate embodiment, motor 50 is two single shaft motors aligned along a common axis. Each single shaft motor is adapted to drive one of shafts 51-1 and 51-2.

Pump inputs 60-1, 60-2 are disposed within the ends 14-1, 14-2 of the secondary leg 14. Pump outputs 70-1, 70-2 extend from pump impellers 52-1, 52-2, respectively, and are rotatable about sixty degrees about a second axis, axis B, shown in FIG. 2. Axis B runs parallel to the secondary leg 14. Moreover, each pump output 70-1, 70-2 is directed into a rotatably connected nozzle 71-1, 71-2. Nozzles 71-1, 71-2 are each rotatable one-hundred-eighty degrees about a third axis, shown as C and C' in FIG. 1. Water drawn into pump inputs 60-1, 60-2 by impellers 52-1, 52-2 and is driven or expelled, under pressure, through nozzles 71-1, 71-2 back into the bath tub.

In an alternate embodiment, pump inputs 60-1, 60-2 have a removable cover 61 secured over the pump inputs. Removable cover 61 has an open structure so as to permit the flow of liquid into pump inputs 60-1, 60-2. Moreover, a filter 63 is disposed between the pump inputs 60-1, 60-2 and the removable cover 61.

Significantly, each nozzle 71-1, 71-2 is independently adjustable about axis C, C'. Also, each pump output 70-1, 70-2 is independently adjustable about axis B. Further, nozzles 71-1, 71-2 are collectively adjustable vertically with respect to the water surface via connection 18 and are rotatable about axis A via connection 18. Spa 1 therefore provides for a wide range of adjustment of the water output from nozzles 71-1, 71-2 and therefore creates an infinite range of water disturbance options.

In an alternate embodiment, nozzles 71-1, 71-2 are removably connected (i.e., sealed) to outputs 70-1, 70-2. In this embodiment, outputs 70-1, 70-2 are adapted to receive a plurality of attachments, such as, but not limited to, a flexible hose 80, a jet roll attachment 85 and/or a rotary nozzle host 82.

Figure 6:
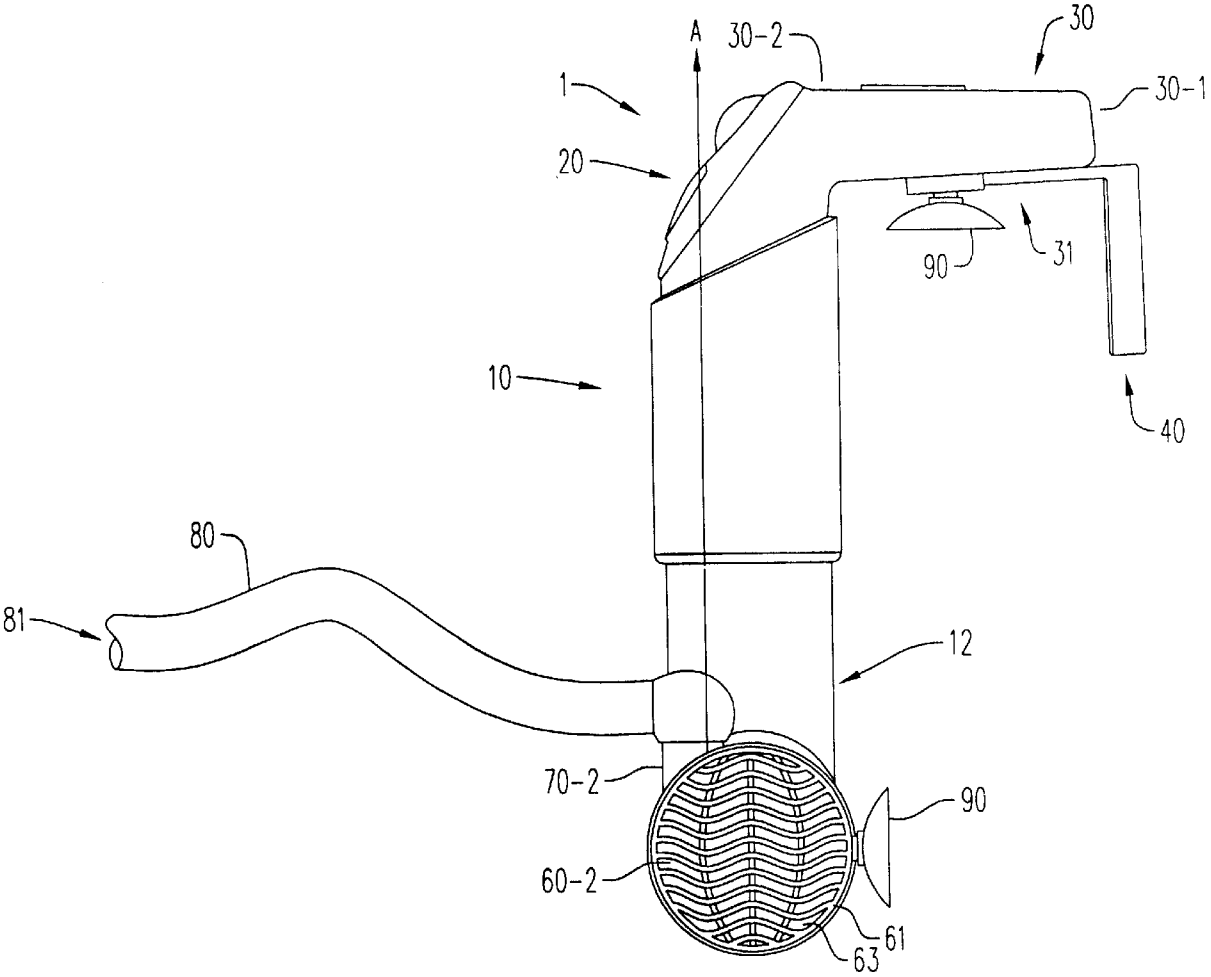
FIG. 6 is a right side plan view of the bath tub spa of FIG. 1 showing an attachment of an alternate embodiment.

As shown in FIG. 6, flexible hose 80 is preferably removably connected to outputs 70-1, 70-2. Flexible hose 80 has a free end 81. Free end 81 is adapted to output water from outputs 70-1, 70-2. In an alternate embodiment, free end 81 is also adapted to receive a plurality of attachments, such as, but not limited to, additional flexible hoses 80, jet roll attachments 85 and/or rotary nozzle hosts 82. In yet another embodiment, flexible hoses 80 includes one or more check valves to prevent the backflow of water through bubble tubes 72-1, 72-2 and out of bubble button 24-1.

Figure 7:
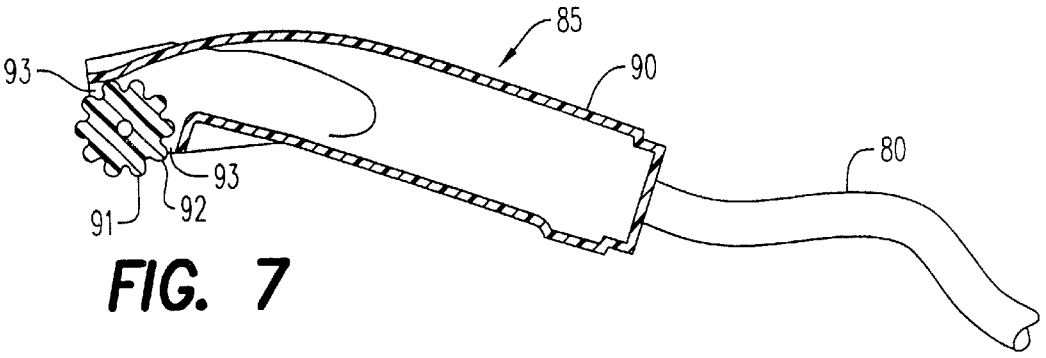
FIG. 7 is a cross sectional view of a first attachment to the bath tub spa of FIG. 1.

Jet roll attachment 85, shown in FIG. 7, has a housing 90, a massage roller 91 and a flexible hose 80. Hose 80 is removably attached to one of outputs 70-1, 70-2. Housing 90 is in fluid communication with flexible house 80 and outputs 70-1, 70-2. Roller 91 is rotatably disposed within housing 90 such that a plurality of water openings 93 are formed. Moreover, roller 91 has a plurality of massaging bumps 92 disposed thereon. Thus, water outputted from outputs 70-1, 70-2 is urged through hose 80 and out of housing 90 through openings 93. In use, a user holds housing 90 and rolls roller 91 over their body as water is forced through opening 93. The combined effect of massaging bumps 92 and water from openings 93 provides a relaxing and beneficial effect for the user.

Figure 8:
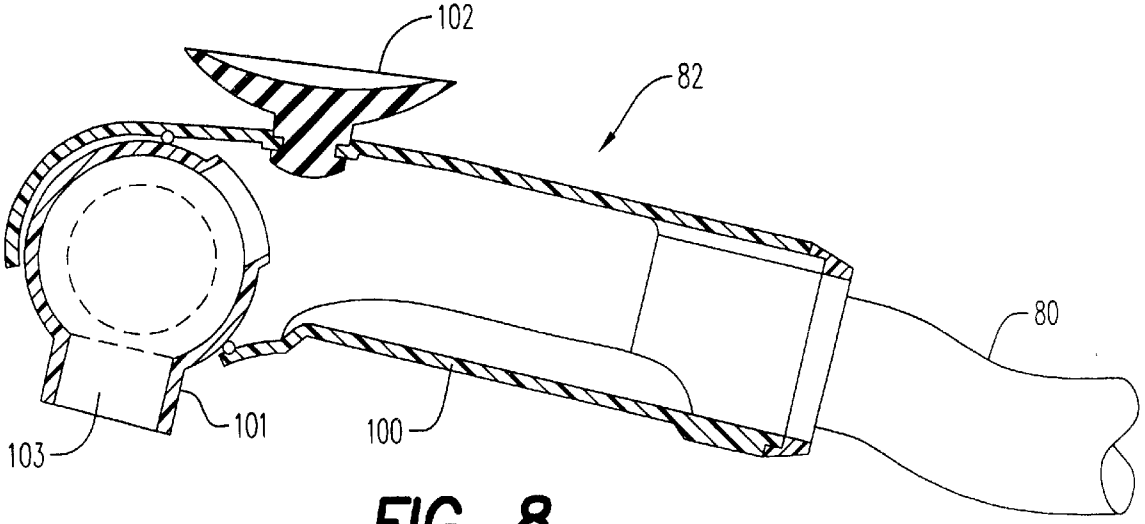
FIG. 8 is a cross sectional view of a second attachment to the bath tub spa of FIG. 1.

Referring to FIG. 8, rotary nozzle host 82 has a housing 100, a rotary nozzle 101, a flexible hose 80 and a suction cup 102. Hose 80 is removably attached to one of outputs 70-1, 70-2. Housing 100 is in fluid communication with flexible house 80 and outputs 70-1, 70-2. Nozzle 101 is rotatably disposed within housing 100 such that an adjustable water opening 103 is formed. Thus, water outputted from outputs 70-1, 70-2 is urged through hose 80 and out of housing 100 through opening 103. In use, a user holds housing 100 or secures housing to the wall via suction cup 102 and adjusts nozzle 101 to direct the water as desired. Rotary nozzle host 82 converts a bath tub into a shower.

It should be noted that the bubble generation feature provided by bubble button 24-1 and bubble tubes 72-1, 72-2 functions with nozzles 71-1, 71-2, as well as the plurality of attachments, such as, but not limited to flexible hose 80, jet roll attachment 85 and/or rotary nozzle host 82 as described above.

It should be understood that the foregoing description is only illustrative of the present invention. Various alternatives and modifications can be devised by those skilled in the art without departing from the invention. Accordingly, the present invention is intended to embrace all such alternatives, modifications and variances which fall within the scope of the appended claims.

What is claimed is:

1. A bath tub spa, comprising:

a motor housing having a motor rotatably driving a first shaft and a second shaft;

a first pump driven by said first shaft and a second pump driven by said second shaft;

an input opening and an output opening sealed about each of said pumps such that each pump draws fluid through its input opening and expels pressurized fluid through its output opening.

2. The bath tub spa of claim 1, further comprising means for removably connecting said motor housing to a lip of a bath tub, when the bath tub has fluid at least a portion of said input openings are maintained below the level of the fluid and at least a portion of said output openings is maintained below the level of the fluid.

3. The bath tub spa of claim 2, wherein said connection means comprises a control housing connected approximately perpendicular to and bisecting said motor housing; and a support arm extending from said control housing, said support arm having a bottom that is adapted to receive the lip of the bath tub.

4. The bath tub spa of claim 2, wherein said motor housing is in slidable and rotatable engagement with said connecting means.

5. The bath tub spa of claim 4, wherein said motor housing is rotatable about a first axis, and wherein said first axis is perpendicular to said shafts.

6. The bath tub spa of claim 5, wherein said motor housing is rotatable about one-hundred-eighty degrees.

7. The bath tub spa of claim 1, wherein each of said output openings is rotatable about a second axis parallel to said shafts.

8. The bath tub spa of claim 7, wherein each of said output openings is rotatable about sixty degrees.

9. The bath tub spa of claim 1, further comprising a nozzle removably sealed to each of said output openings.

10. The bath tub spa of claim 9, wherein each of said nozzles is rotatable about a third axis parallel to said output openings.

11. The bath tub spa of claim 10, wherein each of said nozzles is rotatable about one-hundred-eighty degrees.

12. The bath tub spa of claim 1, further comprising an attachment removably sealed to at least one of said output openings.

13. A portable bath tub spa, comprising:

a pump having an input opening and an output opening sealed about said pump so that fluid is drawn through said input opening and expelled through said output opening;

means for connecting said motor housing to a lip of a bath tub, when the bath tub has fluid at least a portion of said input opening is maintained below a level of the fluid and so that at least a portion of said nozzle is maintained below the level of the fluid, a motor housing having a motor for driving said pump; and wherein said motor housing is rotatable about a first axis, said motor housing is slidable with respect to said connection means, and said output opening is rotatable about a second axis.

14. The bath tub spa of claim 13, wherein said connecting means comprises a control housing connected approximately perpendicular to and bisecting said motor housing; and a support arm extending from said control housing, said support arm having a bottom that is adapted to receive a lip of the bath tub.

15. The spa of claim 13, further comprising a nozzle removably sealed to said output opening.

16. The spa of claim 15, wherein said nozzle is rotatable about a third axis.

17. The bath tub spa of claim 16, wherein said third axis is parallel to said output opening.

18. The bath tub spa of claim 17, wherein said nozzle is rotatable about one-hundred-eighty degrees.

19. The bath tub spa of claim 13, wherein said first axis is perpendicular to the fluid level.

20. The bath tub spa of claim 13, wherein said motor housing is rotatable about said first axis about one-hundred-eighty degrees.

21. The bath tub spa of claim 13, wherein said second axis is parallel to the fluid level.

22. The bath tub spa of claim 13, wherein said output opening is rotatable about said second axis about sixty degrees.

23. The spa of claim 13, further comprising an attachment removably sealed to said output opening.

24. The bath tub spa of claim 13, wherein said motor is a dual shaft motor for driving a pair of shafts wherein each shaft drives a separate pump.

25. The bath tub spa of claim 13, wherein said motor is a pair of motors arranged along a common axis, wherein each motor of said pair of motors drives a shaft and each shaft drives a separate pump.

26. A bath tub spa, comprising:

a pump having an input opening and an output opening sealed about said pump so that fluid within a bath tub is drawn through said input opening and driven through said output opening;

a nozzle removably sealed to said output opening;

a motor housing having a motor for driving said pump; and means for removably connecting said motor housing to the bath tub such that at least a portion of said input opening is maintained below a level of the fluid and at least a portion of said nozzle is maintained below the level of the fluid, wherein said motor housing is rotatable about a first axis, said output opening is rotatable about a second axis, and said nozzle is rotatable about a third axis.

27. The bath tub spa of claim 26, wherein said connecting means comprises a control housing connected approximately perpendicular to and bisecting said motor housing; and a support arm extending from said control housing, said support arm having a bottom that is adapted to receive a lip of the bath tub.

28. The bath tub spa of claim 26, wherein said first axis is perpendicular to the fluid level.

29. The bath tub spa of claim 28, wherein said motor housing is rotatable about one-hundred-eighty degrees.

30. The bath tub spa of claim 29, wherein said motor housing is slidable with respect to the fluid level.

31. The bath tub spa of claim 26, wherein said second axis is parallel to the fluid level.

32. The bath tub spa of claim 26, wherein said output opening is rotatable about sixty degrees.

33. The bath tub spa of claim 26, wherein said third axis is parallel to said output opening.

34. The bath tub spa of claim 26, wherein said nozzle is rotatable about one-hundred-eighty degrees.

35. The bath tub spa of claim 26, wherein said motor is a dual shaft motor for driving a pair of shafts wherein each shaft drives a separate pump.

* * * * *